US009053637B2

(12) United States Patent
Mawbey et al.

(10) Patent No.: US 9,053,637 B2
(45) Date of Patent: Jun. 9, 2015

(54) EMERGENCY VEHICLE ALERT SYSTEM AND METHOD

(71) Applicants: William T Mawbey, Temecula, CA (US); William E. Boyles, Temecula, CA (US)

(72) Inventors: William T Mawbey, Temecula, CA (US); William E. Boyles, Temecula, CA (US)

( * ) Notice: Subject to any disclaimer, the term of this patent is extended or adjusted under 35 U.S.C. 154(b) by 67 days.

(21) Appl. No.: 14/063,348

(22) Filed: Oct. 25, 2013

(65) Prior Publication Data

US 2015/0116133 A1 Apr. 30, 2015

(51) Int. Cl.

| | |
|---|---|
| ***G08G 1/00*** | (2006.01) |
| ***G08G 1/09*** | (2006.01) |
| ***G08G 1/0965*** | (2006.01) |

(52) U.S. Cl.

CPC ..... *G08G 1/092* (2013.01); *G08G 1/0965* (2013.01)

(58) Field of Classification Search

CPC ..... G08G 1/0965; G08G 1/20; G08G 1/087; G08G 1/094; G08G 1/092; G08G 1/161; G08G 1/163; B61L 29/28; H04W 28/06; H04W 92/18; H04W 48/08; H04W 4/04; H04W 4/06; H04W 64/00; H04W 84/18

USPC ..... 340/901, 902, 903, 905, 906, 988, 991, 340/436, 471, 473; 701/117, 301

See application file for complete search history.

(56) References Cited

U.S. PATENT DOCUMENTS

| | | | | |
|---|---|---|---|---|
| 4,952,931 | A * | 8/1990 | Serageldin et al. | 340/902 |
| 6,222,461 | B1 * | 4/2001 | Hazen | 340/901 |
| 6,630,891 | B1 * | 10/2003 | Dilling | 340/902 |
| 6,917,306 | B2 * | 7/2005 | Lilja | 340/903 |

* cited by examiner

*Primary Examiner* — Anh V La

(74) *Attorney, Agent, or Firm* — K C Bean, Esq.

(57) ABSTRACT

A broadcast notification system for providing alert notifications to vehicle drivers. The system recognizes the vehicle type that it has been installed. The system receives vehicle inputs and selects from memory an alert notification associated with a predetermined set of vehicle inputs. Alert messages correspond to vehicle collisions, roadside conditions, dispatch of emergency vehicles and the presence of other stopped roadside vehicles, such as tow trucks, maintenance and repair work vehicles and buses.

19 Claims, 5 Drawing Sheets

EMERGENCY VEHICLE ALERT SYSTEM AND METHOD

CROSS-REFERENCE TO RELATED APPLICATIONS

This is an originally filed provisional application.

BACKGROUND OF THE INVENTION

The present invention is in the technical field of broadcast notification systems for vehicle drivers.

Each year in the United States collisions between dispatched emergency response vehicles and passenger vehicles take the lives of many emergency responders and civilian drivers. According to the National Highway Traffic Safety Administration approximately 200 people each year are killed and many thousands more are injured in collisions involving emergency vehicles responding to calls for service. From the year 2000 to the time of this filing, more than 150 law enforcement officers have been killed and thousands more officers have been injured as a result of collisions with vehicles while responding to calls or attending to incidents along the roadways. Similar statistics are known for tow truck drivers, construction and road maintenance workers and for children boarding and debarking a school bus. To prevent these tragedies there is a need for a robust notification system that warn vehicle drivers about approaching emergency vehicles, the presence of road workers, busses and other roadside incidence.

Emergency and other roadside vehicles such as maintenance workers and busses have historically used flashing lights and audible horns or sirens to notify the public of their presence. However, visual and auditory signals remain inadequate as oftentimes drivers may have obstructed visibility or audible awareness and remain unaware of these indicators.

To overcome these limitations, it has been attempted to program and control traffic signals to allow traffic to flow only in the direction of the responding emergency vehicle. However this approach is limited in that not all geographic areas are covered with signals and it does not provide notice to vehicles travelling in the same direction as the emergency vehicle. Additionally, the system does not address the situation when a vehicle is stopped on the road in the direction of the emergency vehicle.

Attempts have been made to use AM and FM radio signals to provide localized signaling. This approach is also limited in that the nature and specific details of the incident are not communicated. These systems generally override or over power other RF broadcasts in the area and use the vehicles radio system which are within range as the communication channel. To displace other broadcasts, the power output and bandwidth required for these systems far exceeds the allowed limits set by the FCC, causing interference with all RF devices within range. Further, if a driver is listening to recorded sound such as a digital CD or audio player and does not have the radio turned on no signal is received by the motorist.

Some systems have attempted to provide dedicated transmitter/receiver systems with selective messages to be broadcast; however, the system is limited in that it is a one way systems that requires the user to manually select the message type that will be transmitted, which can be impracticable in many situations. Additionally, these systems have limited range and cannot provide warning to vehicles approaching the scene until such vehicle is in range of the incident.

SUMMARY OF THE INVENTION

The present disclosure overcomes the limitations of the prior art and addresses the unsolved need for a broadcast notification system directed to providing messages to alert drivers. It is therefore an object the current inventive broadcast notification system to provide broadcast notifications to vehicle drivers related to vehicle collisions, roadside conditions, dispatch of emergency vehicles and the presence of other stopped roadside vehicles, such as tow trucks, maintenance and repair work vehicles and buses.

Another object of the current invention is to provide a system that can be configured to alert motorist to the presence and directional location of a dispatched emergency response vehicles.

It is also an object of the invention to provide motorist approaching highway work zones a broadcast alert to possible changes in the road and traffic conditions, allowing drivers to proceed safely through construction areas.

Another object of the invention is to provide a system that can provide drivers with broadcast alerts of crashed vehicles and other environmental road hazards.

It is another object of the invention to provide a system that provides motorists notice of a stopped school bus in the area that is loading or unloading children.

It is yet another aspect of the current invention to provide a motorist notice of tow truck operators responding on the interstate.

In another aspect of the invention, a notification is automatically generated by a vehicle to warn other vehicle.

A further aspect of the present invention is to provide to motorists emergency vehicle location and directional data.

Another aspect of the invention is to provide a system for vehicle to vehicle notification for motorists of sudden deceleration and collisions.

It is yet a further aspect of the current invention to mute a vehicle audio or entertainment system to provide for communication of driving events though a vehicles audio speaker or a driver's smart phone.

These and other objects of the invention may be found from a fair reading of the description of the preferred embodiment taken along with the drawings appended hereto. It is to be understood that both the foregoing general description and the following detailed description are exemplary and explanatory only and are not necessarily restrictive of the present disclosure. The accompanying drawings, which are incorporated in and constitute a part of the specification, illustrate subject matter of the disclosure. Together, the descriptions and the drawings serve to explain the principles of the disclosure. The scope of protection sought by the inventors may be gleaned from a fair reading of the claims that conclude this specification.

DESCRIPTION OF THE DRAWINGS

The numerous advantages of the disclosed invention may be better understood by those skilled in the art by reference to the accompanying figures in which.

Figure 1:
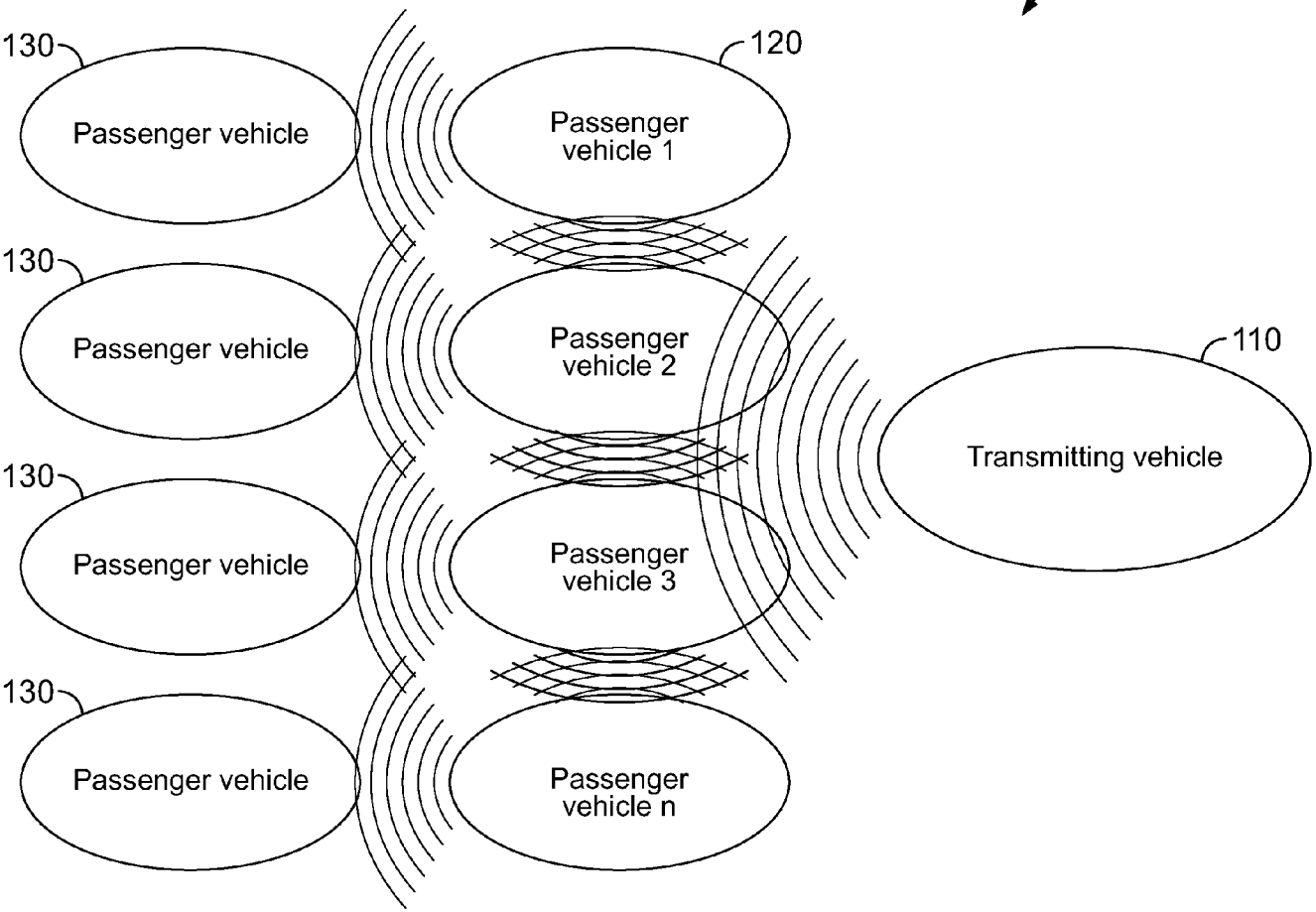
FIG. 1 is a schematic representation depicting a daisy chain distribution configuration of data communication between a plurality of a vehicle.

Reference is now made to the disclosed subject matter, which is illustrated in the accompanying figures. The emergency broadcast notification system of the current invention is broadly implement as demonstrated in FIG. 1. The system 100 provides for wireless communication means from an emergency or roadside vehicle 110 to a plurality of passenger vehicles 120. There are a number of well known wireless communications means that may be implemented, such means including AM radio, FM radio transmissions, Bluetooth®, SSK, FSK, encrypted, and unencrypted, UHF, VHF, and RF formats. The first module (not shown) installed in a first vehicle 110 will initiate the transmission of a broadcast message after receiving a proper set of inputs from the first vehicle 110. After receipt by a second vehicle 120 the broadcast message is rebroadcast by the second vehicle 120 to other vehicles within ranges 130. The number of passenger vehicles 120 that rebroadcast can be limitless, however, the communication capability of the system will be dependent on the power output of the transmission and the proximity of each vehicle to its next adjacent vehicle.

Figure 2:
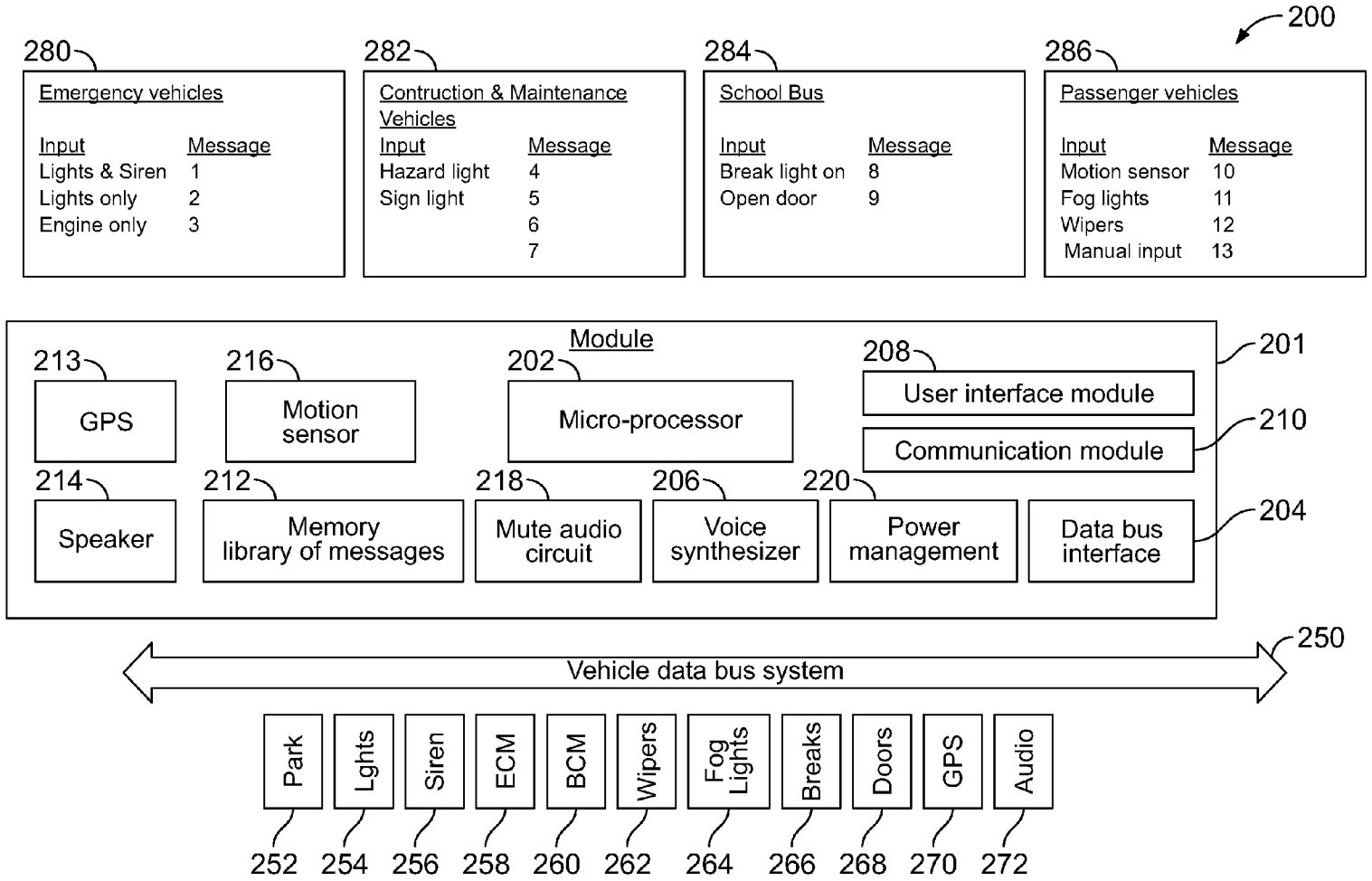
FIG. 2. is a block diagram of in vehicle system of the inventive broadcast notification system.

With reference to FIG. 1 and FIG. 2, broadcast modules 200 are installed in each of the plurality of vehicles 120. FIG. 2, shows the in-vehicle system 200 of the current invention. Each in-vehicle system 200 includes an in-vehicle module 201, which is comprised of a micro-processor 202 for controlling the functions of the module, receiving inputs and sending command messages. The micro-processor 202 will be programmed with embedded machine readable instructions or software code that provides for the configuration and operation of the module 201. The instructions have a module programming mode and an module operations mode, both discussed in more detail below. The user or installer of the module 201 can enter the programming mode to configure the system module 200 using a user interface module 208. The configuration can be accomplished by the user with any standard data input method or devise including PIN switch configuration, a single or multiple input spring loaded switches and light indicators, or through use of an input button and LED screen. At the time of initial installation a startup message may be generated to provide the driver or installer with set up instructions. The user can step through various options allowing the selection of vehicle type in which the module 201 is installed and other preconfigured operating profiles.

During the configuration mode, the module 201 quires the vehicle for vehicle identification and vehicle specification data. The vehicle data is received by the module 201 at a data bus interface 204 through a data connection with a vehicle data bus system 250. During the initial installation, the module 201 may access the vehicle data and determine the type of vehicle in which it is being installed. Vehicle data can be structured as pure digital to digital or analog to digital. There are many well know analog to digital convertors for implementation of the analog to digital embodiment.

Data from various vehicle devices associated with the vehicle bus system 250 can be used to create data profiles to trigger broadcast messages representative of the type of vehicle the module 201 is installed and the message type that will be broadcast. For example, FIG. 2 shows inputs on the data bus as vehicle transmission position 252, lights 254, siren 256, wipers 262, fog lights 264, breaks 266, door pins 268, GPS 270, and audio system 272. If a specified set of vehicle device inputs, representative of the particular vehicle type, is received by the microcontroller 202, an associated broadcast notification message is selected for transmission. The vehicle bus system 250 also include the engine control module 258, which both gathers data from and controls the vehicle drive systems, and the body control module 260, which maintains a number of conveniences and control systems of the vehicle. Data from these modules can also be used to build a profile.

The module 201 is further comprised of a memory 212 for storing a library of voice and broadcast notifications or other messages that can be accessed for broadcasting or play back. FIG. 2 shows messages 1 though 13 associated with four alternative vehicles types, emergency vehicles 280, construction vehicles 282, school bus 284, and passenger vehicles 286. Once the vehicle type is selected during the programming mode, the module 201 stores the selection in memory. The module 201, then uses a corresponding set of preprogrammed data input value parameters as a profile, the parameters associated with a chosen vehicle type, and selects from the memory library 212 a notification corresponding to the selected profile. For example, if module 201 is installed in a police car, the microcontroller 202 will select from the library 212 a set of input values 1-13 the corresponding to vehicle bus 250 inputs associated with a police car while in operational mode, such as lights and sirens. Then the microcontroller 202 will then broadcast the voice or broadcast notices selected from the profiles stored in the library 212 associated with a police car. The set of messages or broadcast notifications associated with particular events are communicated between modules 200 in the plurality of vehicles 120. The messages communicated between modules 200 are preferably encoded digital RF signals, which may include encrypted or unencrypted encoded portions. The voice message may be digitally generated by a voice module 206 or recorded analog by an installer or user at the time of installation.

Broadcast messages 1 through 13 are stored in the module memory 212, which can also be accessed during the programming mode to allow for recording of individualized or unique massages that can be added to the library 212 and triggered upon the occurrence of a specified event. Preferably each message 1 through 13 is pre-recorded into memory 212 at the time of manufacturing. The library 212 can come with prerecorded voice and broadcast notices in the form of an audible alert, siren or voice messages comprising various alert notifications and reminder messages to warn motorist of emergency or driving events in their vicinity that require their immediate attention.

The module 200 includes a communication module 210 using radio frequency (RF) transceiver to allow communication between a plurality of modules 200. Each broadcast notification 1 through 13 is preferably transmitted at 2.4 GHz, which is a band dedicated to short range communication devices, including Bluetooth, ZigBee, and other IEEE transmission protocols. The communication module 210 can be a one way system or preferably a two way transmitter/receiver system that can transmit an RF signal at least 1500 feet and preferably up to 3000 feet. The communication module 210 is associated with an antenna (not shown) that enhances the transmission and receipt of RF signals between a plurality of modules 200. The antenna may be the vehicle antenna associated with the vehicle radio or may be a standalone antenna that is dedicated to the communication module 210.

During the operating mode, after being received, the broadcast notifications 1 through 13 may be presented to vehicle drivers through the module 200 by a number of interface modalities such as light flashes, electronic display, LED screen, but is preferably a voice synthesizer (206) that generates a voice message projected by a small speaker 214. In one embodiment of the invention, a short range local RF communication link is provided to allow communication of broadcast notifications 1 through 13 to local devices such as smart phones or hand held audio players. The communication link in this embodiment is any form of local RF, but is preferably the Bluetooth® standard. The local communication link provides notices 1 through 13 directly to a smart phone or other device that is within the vehicle range of the broadcast signal.

Each module 201 can be customized and provided individualized messages at the time of start of a vehicle ignition. Messages may be programmed by the car dealer that sells the vehicle to trigger upon receipt by the controller of specified data input from the vehicle bus 250. For example, oil changes at specified odometer readings.

Further, the module 200 can be used as a communications relay to retransmit the originally received message to other nearby modules 200, acting to amplify the range of notification to surrounding vehicles 120, thus expanding the overall area of coverage. If desired for a particular application the RF signal can be focused to make the signal directional using known signal reflecting and other signal cancellation and redirection techniques.

Each module 200 may also comprise a motion, accelerometer, crash or shock sensor means 216 to provide sensing of a sudden vehicle deceleration or that a vehicle collision has occurred. Airbag deployment data from the BCM 260 may also trigger an input to the module 200 and initiation a crash broadcast message. Upon receiving a sensor input indicating a sudden deceleration, the module 200 transmits a signal to alert other vehicle drivers in the vicinity of the impact incident occurring in the vehicle ahead.

Each module 200 is further comprised of an audio output device 214. The audio output 214 can be any well know means for generating an audible sound such as a transducer. Preferably, the module 200 interfaces with the vehicles data bus system to provide an audible message through the bus 250 to the vehicles entertainment system. The module 200 may also be hardwired into the audio head unit with an RCA jack or other electrical connection. The module 200 may include a small stand alone speaker or speaker box that is connected to the module 200 by way of a standard electrical audio jack.

Each module 200 may contain an audio mute circuit 218 that over rides and mutes vehicles' sound system or the driver's cellular phone to assure the broadcast notification is clearly heard by drivers. The mute function can be accomplish by a variety of well known means such as software or power cut off circuit. In the case of a driver's cell phone, muting is preferably accomplished using low energy Bluetooth® communication between the module 200 and the driver's phone, which have previously been paired. In the case of the vehicle's entertainment system, the interface 204 provides a mute signal to the vehicle's audio system 272 through the vehicle's data bus 250. Once the audio system 272 has been muted, and the alert message has played or the receipt of broadcast has stopped, the audio system 272 returns back to its original playing mode. It will be appreciated by one skilled in the art that the mute function can be performed by direct interface with the vehicle audio head unit.

Power and ground for the module 200 is managed by a power management circuit 220 and is preferably provided by direct connection to the vehicle's electrical system and may include a battery backup (not shown). The direct connection can be provided by use of a power jack inserted into the vehicle's cigarette lighter or similar plug, or it may be through physical hard wiring to the vehicle's 12 volt power circuit. Power can also be provided from the lights and siren system of an emergency response vehicle.

Figure 3:
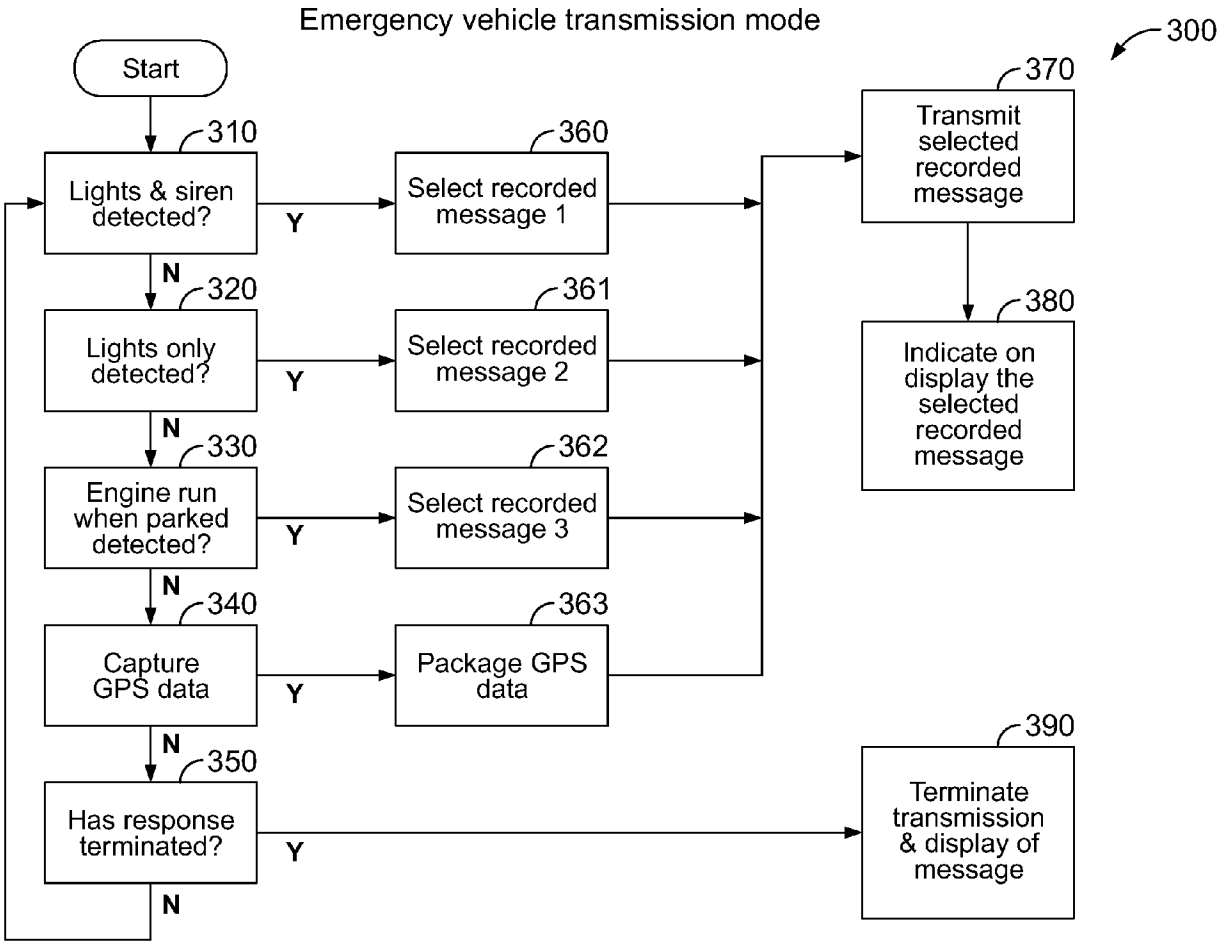
FIG. 3 is a flow diagram representing the emergency vehicle transmission mode of the current invention.

FIG. 3 shows a representation of the logic of one embodiment of the invention related to responses by emergency vehicles 300. Modules, as described in FIG. 2, are installed in an emergency vehicle. The module is capable of detecting when the emergency vehicle is in various operational states, including, but not limited to, lights and siren mode, lights only mode, engine run mode. The module in the emergency vehicle receives data from the vehicle data bus. The data can indicate the state of vehicle emergency lights. The states may include lights flashing with the siren sounding 310, lights flashing only 320, or that the engine is running while the vehicle is parked 330. When an emergency vehicle is in a particular operational mode, the module transmits a message corresponding to the respective mode 360, 361, 362, and 363 for transmission 370 and receipt by other vehicles in proximity having a module. The modules will automatically select from the library stored in memory an appropriate broadcast message 360, 361, 362 already associated with the vehicle data inputs and broadcast 370 the selected alert to motorist within range of the broadcast signal that are approaching the emergency vehicle. When in lights and siren mode 310, the module in the emergency vehicle generates and transmits a message indicating that an emergency vehicle has been dispatched and is responding nearby; drivers should proceed with caution and be prepared to pull over. If the emergency vehicle is stopped roadside with only lights flashing, the module installed in the emergency vehicle will transmit a notice that there is an stopped emergency vehicle ahead and you are approaching an emergency incident area ahead; use caution emergency responders in the roadways. If the emergency vehicle is in engine run mode without lights or siren 330, a message is transmitted that there is an stopped emergency vehicle ahead. Motorist will be provided with an appropriate notification and instructed to use caution when approaching incident locations or intersections and that they should be prepared to move over if an emergency vehicle is sighted. For example, "warning, emergency vehicle in the area. Use caution when approaching intersections. Be prepared to move over or stop if emergency vehicle is sighted", "warning, there is an emergency vehicle responding to an incident ahead. Vacate the lane nearest the emergency vehicle or slow down 20 miles an hour under the posted speed limit if unable to change lanes". The message is broadcast at a distance and time significantly greater than that provided by lights and siren alone. It is anticipated that any number of vehicle states can be correlated to particular messages that are transmitted when the vehicle is in such state. The module will also display to the transmitting emergency vehicle the message that has been or is being broadcast 380. Activation of the transmission can be automatic upon receipt of the proper vehicle status input indicators. When a specified input is received by the module from the emergency vehicle, selection of the message and transmission will automatically begin. No input from the emergency vehicle driver is necessary.

The transmitting module may collect from the emergency vehicle real time GPS location data 340 that will be packaged with the broadcast notice 363 and transmitted 370 in the message. It will be appreciated by one skilled in the art that there are many know types of GPS data collection means. Location data broadcast by the transmitter is compared to the location data obtained in the receiver to provide motorists with information regarding distance to and direction of the emergency vehicle. When the system alerts motorist to the approach of an emergency vehicle, or of their approach to an emergency vehicle tending to a roadway incident, those drivers will have the time to examine their surroundings and select a safe route to move out of the way of that emergency vehicle, thus allowing for safe passage through traffic for all.

Figure 4:
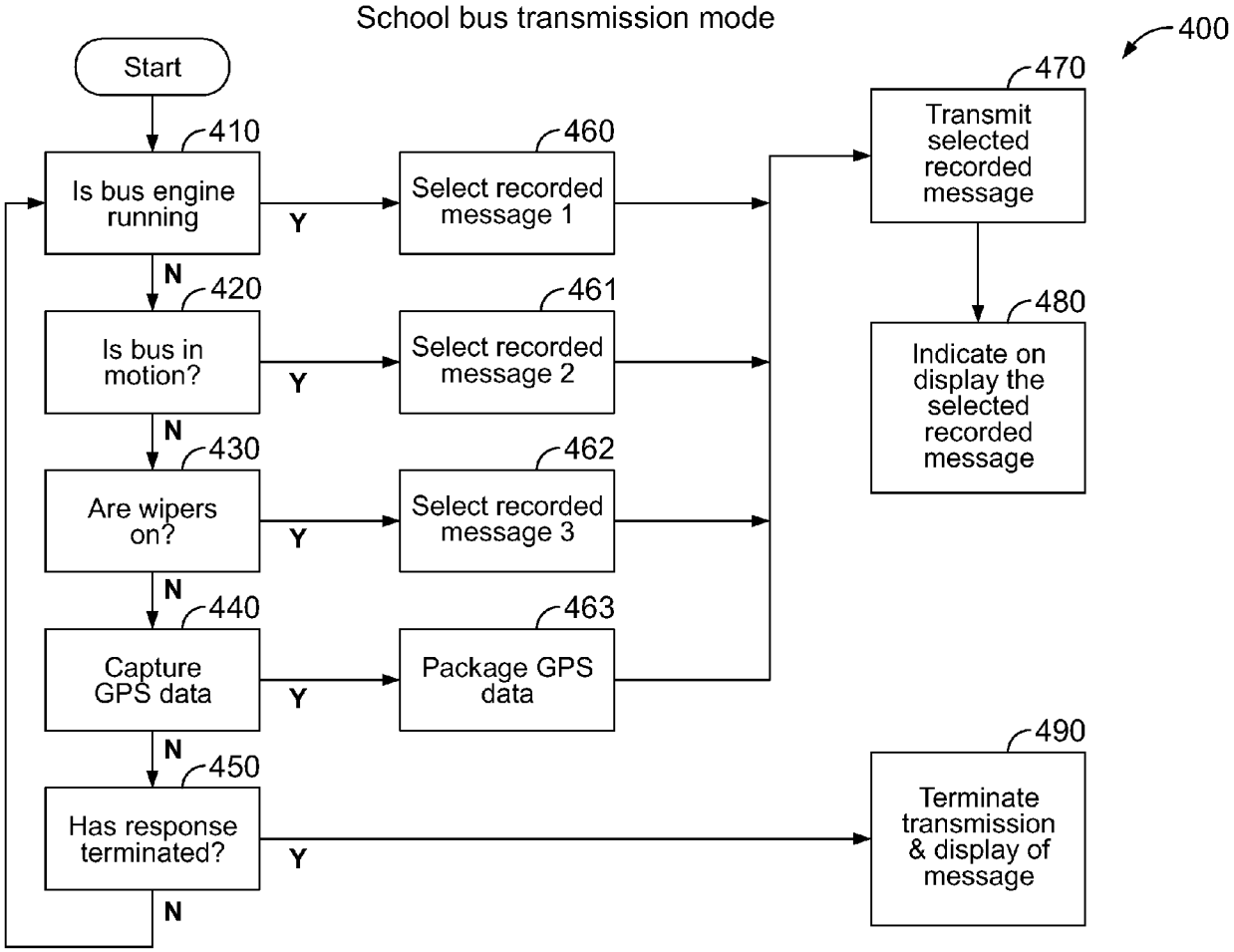
FIG. 4 is a flow diagram representing the school bus transmission mode of the current invention.

In another embodiment, the module may be installed in school buses to alert other drivers in proximity of the presence of the stopped school bus, children loading, unloading or crossing the roadways and the posted speed limit. FIG. 4 shows representative logic of the programming of a module in a school bus for selecting particular message sets associated with school bus vehicle inputs 400. At 410, the module receives data from the data bus system of the school bus. Alternatively, the data can be received directly through hard wiring of the module to various devices on the vehicle and analog signals are converted to digital inputs. Communication between the module and devices could also be wireless through Bluetooth® or other local RF systems. If the engine is running 410, a notification is selected from the library of messages stored in memory 460 and transmitted 470. For example, "Warning, you are approaching a stopped school bus. Use caution as children may be present. Do not proceed until school bus flashing lights have turned off". A selected message is also displayed 480 in the transmitting vehicles module to notify the driver of the type of notification that has been transmitted. If additional data is received, indicating the vehicle is in motion 420, or the wipers are on 430, other messages are selected 461 and 462 respectively and are transmitted 470. If the vehicle is in motion 420, GPS data is captured 463 and packaged with the message 463 for transmission, allowing the receiving module to compare the busses coordinates against the receiving modules coordinates and providing a distance and location message. If all inputs have ceased 450 then all transmissions are ended 490.

Figure 5:
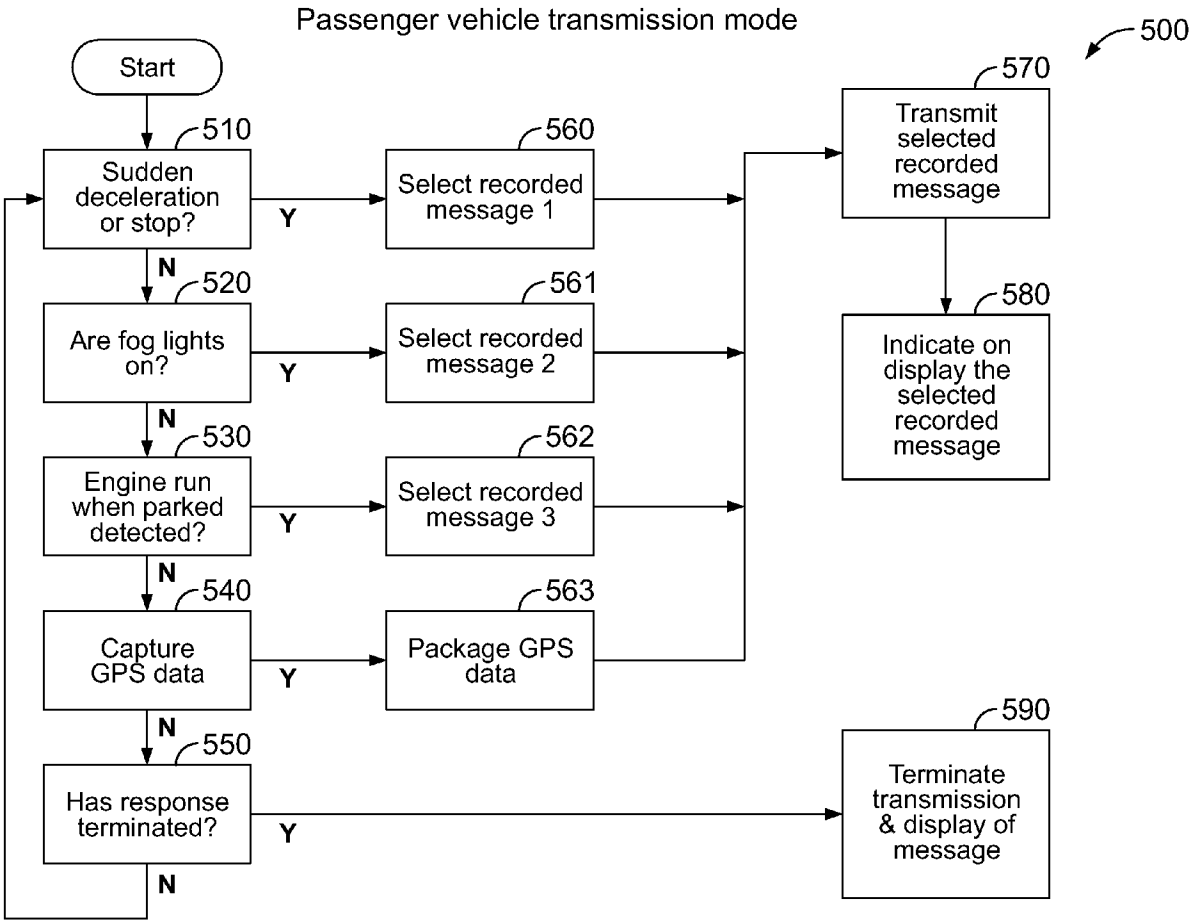
FIG. 5 is a flow diagram representing the passenger vehicle mode of the current invention.

In another embodiment, the module can also be utilized to alert drivers of passenger vehicles equipped with similar modules to collisions that have occurred ahead and other adverse traffic conditions such as dense fog, wet road and road debris. Similar to other embodiments, FIG. 5 shows the logic 500 for the selection of messages in passenger vehicles associated with specified types of driving conditions. The type of message can be manually selected by the user using an input selection button or the message can be generated automatically based on activity of devices and sensor data use by the vehicle and shared on the vehicles data bus. If a sudden deceleration or stop is detected 510 the module will select a broadcast notification 560 that transmits 570 "Warning, heavy braking ahead. Proceed with caution. Be prepared to slow down". If the module receive from the vehicle data bus system data indicating the fog lights are on 520 a message is selected from the library 561 that there is "fog ahead, reduce your speed and proceed with caution." The message is then broadcast 570. If the module detects the engine running with the transmission in the parked positions and the GPS coordinates are not in a "home location" then a message reporting a roadside vehicle ahead is selected 562 and transmitted 580. Like other embodiments, GPS coordinates can be captured 540 and packaged with a notification 563 and transmitted 570.

It is anticipated that any number of roadside or traffic conditions can have associated notifications. For example, if the windshield wipers are in motion and the temperature is below 32 degrees, a notice can be transmitted that it is snowing. If the wiper are in motion and it is above 32 degrees, the message transmitted is that it is raining, wet roads proceed with caution. If traction control data is received, then a notice that the roads are icy, proceed with caution is sent.

In yet another embodiment, the module is installed in tow truck, road construction or road maintenance crew vehicle to provide notification to approaching drivers. Motorist approaching highway work zones can be alerted to possible shifts in traffic lanes allowing them to proceed safely through those areas. Tow truck operators responding on the interstate can work in a safer environment because the system functions to alert motorist to their presence and to use caution. "Warning, there is an emergency vehicle responding to an incident ahead. Vacate the lane nearest the emergency vehicle or slow down 20 miles an hour under the posted speed limit if unable to change lanes".

In another embodiment, the module can be configured for installation in a train or at a railroad crossing gate. When a railroad crossing gate is lowered, the module sends a notification of an approaching train and lowered railroad crossing gate.

While the above description has pointed out novel features of the present disclosure as applied to various embodiments, the skilled person will understand that various omissions, substitutions, permutations, and changes in the form and details of the present teachings may be made without departing from the scope of the present teachings.

Each practical and novel combination of the elements and alternatives described hereinabove, and each practical combination of equivalents to such elements, is contemplated as an embodiment of the present teachings. Because many more element combinations are contemplated as embodiments of the present teachings than can reasonably be explicitly enumerated herein, the scope of the present teachings is properly defined by the appended claims rather than by the foregoing description. All variations coming within the meaning and range of equivalency of the various claim elements are embraced within the scope of the corresponding claim. Each claim set forth below is intended to encompass any apparatus or method that differs only insubstantially from the literal language of such claim, as long as such apparatus or method is not, in fact, an embodiment of the prior art. To this end, each described element in each claim should be construed as broadly as possible, and moreover should be understood to encompass any equivalent to such element insofar as possible without also encompassing the prior art.

We claim:

1. A broadcast notification system for providing alert messages to a plurality of vehicle drivers within an alert zone comprising:

a base transmitter unit, said base transmitter unit installed in a first vehicle and comprising:

a data input means for receiving data from a first vehicle having a plurality of installed devices, said data corresponding to the status of each installed device, a non-volatile memory for storing a plurality of coded signals, each coded signal corresponding to an alert message and associated with a predetermined set of device status inputs profiles, a data processor, for receiving status input data originating from the plurality of vehicle devices and for retrieving from memory a coded signal correspond to one of said predetermined set of status input profiles when the received inputs from devices match a profile, a radio frequency transmitter associated with an antenna, for generating and transmitting the retrieved coded signal;

a plurality of transceiver units, each transceiver unit mounted in at least one second vehicle, and comprising:

a radio frequency receiver associated with an antenna for receiving the coded signal transmitted from the base transmitter unit a non-volatile memory for storing a plurality of coded signals, each coded signal corresponding to an alert message, a data processor for comparing the received coded signal and the stored coded signals and selecting from memory the corresponding alert message and audibly or visually reproducing the alert message within each second vehicle, a radio frequency transmitter associated with an antenna for generating and retransmitting the received coded signal to other transceiver units within the transmission vicinity.

2. The broadcast notification system of claim 1 wherein the alert message is audible and reproduced with a transducer.

3. The broadcast notification system of claim 2 wherein the system is in communication with the vehicle's data bus system to provide an audible message through the vehicle data bus to the vehicle entertainment system.

4. The broadcast notification system of claim 1 further comprising an audio mute circuit, wherein at least one vehicle device is an audio system and the data processor is in communication with the audio system, whereby the vehicle audio system is muted upon receipt of the coded signal for a time duration sufficient to play a voice simulation of the alert message and is un-muted upon completion of the alert message transmission.

5. The broadcast notification system of claim 1 wherein the alert message is visually reproduced with a plurality of LED indicators or an LED display.

6. The broadcast notification system of claim 1 further comprised of a global positioning satellite receiver, wherein location coordinates of the first vehicle are transmitted with the coded signal and presented to the at least one second vehicle.

7. The broadcast notification system of claim 6 wherein the alert message alerts motorist to the presence and directional location of a dispatched emergency response vehicles.

8. The broadcast notification system of claim 1 wherein the alert message relates to vehicle collisions, roadside conditions, dispatch of emergency vehicles or the presence of stopped roadside vehicles.

9. The broadcast notification system of claim 1 further comprising an accelerometer, wherein the base transmitter unit provides a coded signal corresponding to a crashed vehicles or roadside hazard when there is a sudden deceleration.

10. The broadcast notification system of claim 1 wherein the user can select at the time of system installation in the vehicle an input corresponding to the type of vehicle the system is installed, the system then provides alert messages based on the selected input.

11. The broadcast notification system of claim 1 wherein an alert message is automatically generated.

12. The broadcast notification system of claim 6 wherein the system provides for emergency vehicle location and direction data to motorists.

13. The broadcast notification system of claim 1 wherein an alert message recorded into memory upon entering a record mode.

14. The broadcast notification system of 1 wherein the base unit further comprising an LED that is illuminated when the base unit is transmitting an encoded signal.

15. The broadcast notification system of claim 5 wherein the LED illuminate indicator arrows to indicate the direction the transmission is received.

16. A broadcast notification system for providing alert messages to a plurality of vehicle drivers within an alert zone comprising:

a base transmitter unit, said base transmitter unit installed in a first vehicle and comprising:

a user input means, a non-volatile memory for storing a plurality of coded signals, each coded signal corresponding to an alert message and associated with a predetermined user input, a data processor, for receiving user inputs and for retrieving from memory a coded signal corresponding to one of said predetermined user input, a radio frequency transmitter associated with an antenna, for generating and transmitting the coded signal retrieved from memory;

a plurality of transceiver units, each transceiver unit mounted in at least one second vehicle and comprising:

a radio frequency receiver associated with an antenna for receiving the coded signal transmitted from the base transmitter unit a non-volatile memory for storing a plurality of coded signals, each coded signal corresponding to an alert message, a data processor for comparing the received coded signal with signal stored in memory and selecting the corresponding alert message and audibly or visually reproducing the selected alert message within each second vehicle, a radio frequency transmitter associated with an antenna for generating for retransmitting the received coded signal to other transceiver units within the transmission vicinity.

17. The broadcast notification system of claim 16 wherein each of said plurality of user selectable inputs corresponds with a on a unique radio frequency.

18. A broadcast notification system for providing alert messages to a plurality of vehicle drivers within an alert zone comprising:

a base transceiver unit associated with an antenna, said base transceiver unit installed in a first vehicle and comprising:

a data input means for receiving data from a first vehicle having a plurality of installed devices, said data corresponding to the status of each installed device, a non-volatile memory for storing a plurality of coded signals, each coded signal corresponding to an alert message and associated with a predetermined set of status input profiles, a data processor, for receiving status input data originating from the plurality of vehicle devices and for retrieving from memory a coded signal correspond to one of said predetermined set of status input profiles when the received inputs from devices match a profile, wherein the base transmitter receives the coded signal transmitted by adjacent vehicles and retransmitting said signal;

a plurality of remote transceiver units, each remote transceiver unit associated with an antenna and mounted in at least one second vehicle and comprising:

a data input means for receiving data transmitted from said first vehicle, a non-volatile memory for storing a plurality of coded signals, each coded signal corresponding to an alert message, a data processor for comparing the received coded signal and selecting from memory the corresponding alert message and audibly or visually reproducing the alert message within each second vehicle, receiving the coded signal transmitted from the base transceiver unit and generating and retransmitting the received coded signal to other transceiver units within the transmission vicinity.

19. The broadcast notification system of claim 1, 16 or 18 wherein the alert message provide motorist approaching highway work zones an alert message to changes in the road and traffic conditions.

* * * * *